United States Patent [19]

Caron et al.

[11] 4,016,010

[45] Apr. 5, 1977

[54] PREPARATION OF HIGH STRENGTH COPPER BASE ALLOY

[75] Inventors: Ronald N. Caron, Branford; Stanley Shapiro, New Haven, both of Conn.

[73] Assignee: Olin Corporation, New Haven, Conn.

[22] Filed: Feb. 6, 1976

[21] Appl. No.: 655,791

[52] U.S. Cl. ..... 148/12.7 C

[51] Int. Cl.[2] ..... C22F 1/08

[58] Field of Search ..... 148/12.7 C, 11.5 C; 75/159

[56] References Cited

UNITED STATES PATENTS

| | | | |
|---|---|---|---|
| 3,258,334 | 6/1966 | Kessler | 75/159 |
| 3,399,057 | 8/1968 | Richardson et al. | 75/159 |
| 3,405,015 | 10/1968 | Ferrero | 75/159 |

*Primary Examiner*—W. Stallard

*Attorney, Agent, or Firm*—Robert H. Bachman; Robert A. Dawson

[57] ABSTRACT

Spinodal, precipitation hardened copper base alloy is prepared having high strength and favorable strength to ductility characteristics. The alloy consists essentially of from 10 to 30% nickel, 1 to 5% aluminum and the balance essentially copper. The microstructure of the alloy is characterized by including finely dispersed precipitates of $Ni_3Al$ particles dispersed throughout the alloy matrix.

13 Claims, No Drawings

PREPARATION OF HIGH STRENGTH COPPER BASE ALLOY

BACKGROUND OF THE INVENTION

It is highly desirable to provide copper base alloys having high strength properties and favorable strength to ductility characteristics. It is particularly desirable to provide low cost hot and cold workable copper base alloys which are characterized by high mechanical strength, favorable strength to ductility combinations and excellent formability characteristics. It is especially desirable to provide copper base alloys characterized as aforesaid which are convenient to process and which may be made economically on a commercial scale.

It is highly desirable to provide alloys of the foregoing type which satisfy the stringent requirements imposed by modern applications for electrical contact springs in which high strength is required coupled with good bend formability as well as resistance to mechanical property degradation at moderately elevated temperatures, such as stress relaxation resistance.

Commercially, copper alloys tend to be deficient in one or more of the foregoing characteristics. For example, the commercial copper Alloy 510 (a phosphor-bronze containing from 3.5 to 5.8% tin and from 0.03 to 0.35% phosphorus) is superior in strength but poor in bend characteristics. The commercial copper Alloy 725 (a copper-nickel containing 8.5 to 10.5% nickel and 1.8 to 2.8% tin) is superior with respect to bend properties, solderability and contact resistance, but deficient in strength.

The present invention relates to the preparation of spinodal, precipitation hardened copper base alloys having an unusual combination of properties based on a composition containing from 10 to 30% nickel and from 1 to 5% aluminum. Nickel-aluminum containing copper base alloys are known in the art, such as disclosed in U.S. Pat. Nos. 2,101,087, 2,101,626 and 3,399,057; however, these teachings do not contemplate the preparation of spinodal, precipitation hardened copper alloys having finely dispersed precipitates of $Ni_3Al$ particles as disclosed in the present invention.

Accordingly, it is a principal object of the present invention to provide a method for the preparation of improved copper base alloys having high strength and favorable strength to ductility characteristics.

It is a further object of the present invention to provide a method for preparing an improved copper base alloy as aforesaid which has other good properties, such as excellent formability characteristics in the precipitation hardened condition and resistance to mechanical property degradation at moderately elevated temperatures, such as stress relaxation resistance.

It is a still further object of the present invention to provide a method for preparing an improved copper base alloy as aforesaid which is convenient and economical to prepare on a commercial scale.

Further objects and advantages of the present invention will appear hereinbelow.

SUMMARY OF THE INVENTION

In accordance with the present invention it has been found that the foregoing objects and advantages may be readily achieved. The present invention resides in the preparation of a spinodal, precipitation hardened copper base alloy having high strength and favorable strength to ductility characteristics consisting essentially of from 10 to 30% nickel, 1 to 5% aluminum, and the balance essentially copper, wherein the matrix of the alloy is characterized by including finely dispersed precipitates of $Ni_3Al$ particles dispersed throughout the alloy matrix.

The nickel and aluminum contents provide the precipitation hardening mechanism through the precipitation of the $Ni_3Al$ type phase from a solution treated and cooled or solution treated, cooled and cold worked matrix. The morphology of the precipitate is controlled through appropriate choice of processing and/or alloying schemes. The control of the finely dispersed precipitate morphology in turn controls the strength to ductility combination offered by the remarkable alloy system of the present invention.

The process of the present invention comprises: providing an alloy having a composition as aforesaid; hot working (preferably rolling) said alloy with a finishing temperature in excess of 400° C; solution annealing the alloy for from 10 seconds to 24 hours at a temperature of from 650°–1100° C; and cooling the alloy to room temperature to provide a spinodal, precipitation hardened copper base alloy wherein the microstructure is characterized by the presence of finely dispersed precipitates of $Ni_3Al$ particles dispersed throughout the matrix.

The process of the present invention is surprisingly versatile and a great many variations may be employed to provide a wide variety of property combinations. A homogenization treatment may be employed prior to hot rolling, or as part of the hot rolling operation. The alloy may be cold worked (preferably rolled) with or without intermediate anneals after hot rolling and prior to solution annealing.

Processing following the solution anneal is particularly important in obtaining property variations. Thus, one may water quench from solution anneal followed by aging or cold rolling and aging. Alternatively, one may cool slowly to ambient temperature and use the alloy in that condition, or age, or cold roll and age, or cool slowly directly to aging temperature followed by cooling to ambient temperature.

The preferred working operation is rolling and will be discussed as such throughout the present specification; however, any working operation may be used, such as extrusion, forging or wire drawing.

The alloys prepared in accordance with the process of the present invention are processed to provide finely dispersed $Ni_3Al$ type precipitates of three morphologies depending upon desired mechanical properties and/or processing characteristics. Firstly, the finely dispersed $Ni_3Al$ type precipitates may be formed as large agglomerated grain boundary particles or scattered spheroidal dispersoid particles provided by the mechanism of classical nucleation and growth of second phase particles at the grain boundaries or lattice defects. A second type of finely dispersed precipitates is characterized by the $Ni_3Al$ type precipitates formed in a finely dispersed manner by separating from the alpha copper constituent by the mechanism of discontinuous precipitation. A third type of finely dispersed $Ni_3Al$ precipitate is characterized by a precipitate being formed as an array of extremely finely dispersed, coherent particles.

The foregoing finely dispersed precipitates find their origin in a spinodal decomposition of the supersaturated solid solution followed by coarsening and transformation of the solute rich regions into $Ni_3Al$ pre-precipitates and equilibrium precipitate particles. The spinodal decomposition mechanism provides for the unusual strength to ductility combinations which are achieved by the alloy system of the present invention. This is particularly surprising since other spinodal type alloys do not exhibit this unusually good strength to bend ductility in the aged condition, e.g., the copper-nickel-tin system does not exhibit these properties.

DETAILED DESCRIPTION

As indicated hereinabove, the present invention resides in the preparation of a family of hot and cold rollable, spinodal, precipitation hardened copper base alloys containing nickel and aluminum. The alloys prepared in accordance with the process of the present invention are characterized by a combination of excellent properties including high mechanical strength, favorable strength to ductility combinations, excellent formability in the precipitation hardened condition, and resistance to mechanical property degradation at moderately elevated temperatures, such as stress relaxation resistance.

Throughout the present specification, percentages of materials refers to weight percentages.

The nickel content in the alloy of the present invention will vary from 10 to 30% and is preferably maintained in the range of fron 10 to 20%. The aluminum content will vary from 1 to 5% and is preferably maintained in the range of 1.5 to 3.5%.

Other alloying ingredients may be included in the alloy of the present invention in order to obtain particular combinations of properties. Thus, a total of up to 20% of one or more of the following materials may be included: Titanium, zirconium, hafnium, beryllium, vanadium, niobium, tantalum, chromium, molybdenum, tungsten, zinc, iron and tin. The zinc, iron and tin components may be used in an amount from 0.01 to 10% each and are employed to provide additional solution strengthening, work hardening and precipitation hardening since they partition equally or preferentially to the nickel-aluminum rich precipitate and to the alpha copper matrix, thereby making the matrix and precipitate harder by affecting the lattice parameters of the matrix and the precipitate so as to increase the interfacial coherency strains and to provide for enhanced precipitation hardening. In addition, the iron in solution restricts grain growth.

The titanium, zirconium, hafnium and beryllium components may be employed in an amount from 0.01 to 5% each. These materials provide for a second precipitated particle in the alloy matrix by forming intermediate phases with copper and/or nickel. The vanadium, niobium, tantalum, chromium, molybdenum and tungsten components may also be employed in an amount from 0.01 to 5% each. These components are desirable since they provide for second precipitate particles in the alloy matrix in their own elemental form. Therefore, the titanium, zirconium, hafnium, beryllium, vanadium, niobium, tantalum, chromium and molybdenum or tungsten or mixtures of these may readily be utilized in the alloy system of the present invention in order to provide additional particle hardening, with the alloy matrix including second precipitate particles containing said materials, or to provide improved processing characteristics, such as providing for grain size control. Moreover, even small amounts of each of the foregoing elements are capable of influencing the reaction kinetics and morphology hardness of the base $Ni_3Al$ precipitation process.

In addition to the foregoing, a total of up to 5% of one or more of the following materials may be present in an amount from 0.001 to 3% each: Lead, arsenic, antimony, boron, phosphorus, manganese, silicon, a lanthanide metal, such as mischmetal or cerium, magnesium and/or lithium. These materials are useful in improving mechanical properties or corrosion resistance or processing. The alloy melt may be deoxidized with such additions as are traditionally used to deoxidize or desulphurize copper, such as manganese, lithium, silicon, boron, magnesium or mischmetal. In fact, even those elements listed above as solution or precipitation or dispersed additives may be used in small amounts to deoxidize the melt, such as titanium, zirconium, hafnium, chromium, molybdenum and excess aluminum.

Naturally, arsenic and antimony additions may be used to promote corrosion resistance. Moreover, compositions containing lead, sulfur and/or tellurium additions would provide the additional benefits of a highly machinable alloy, provided, however, that these alloys would not be readily hot rollable.

As discussed hereinabove, the nickel and aluminum components of the alloy of the present invention provide the precipitation hardening mechanism through the spinodal precipitation of the $Ni_3Al$ type phase from a solution treated and cooled, or solution treated cooled and cold rolled matrix. Appropriate choice of processing and/or alloy schemes may be used to control the morphology of the precipitate and in turn controls the strength to ductility combinations in the alloy system of the present invention.

Hence, as indicated hereinabove, a key feature of the alloy of the present invention is the presence of finely dispersed precipitates of $Ni_3Al$ particles which are dispersed throughout the alloy matrix. The alloys may be processed to provide $Ni_3Al$ type precipitates of three morphologies depending upon desired mechanical properties and/or processing characteristics. A first of these morphologies, type (1), is characterized by finely dispersed $Ni_3Al$ type precipitates formed as agglomerated grain boundary particles, or scattered spheroidal dispersoids provided by the mechanism of classical nucleation and growth of second phase particles at grain boundaries or at lattice defects. A second, type (2), of finely dispersed $Ni_3Al$ type precipitates may be formed in a finely dispersed manner by separating from the alpha copper constituent by the mechanism of discontinuous precipitation. A third, type (3), of finely dispersed precipitates of $Ni_3Al$ type precipitate may be formed as an array of extremely finely dispersed, coherent particles.

The foregoing finely dispersed precipitates of $Ni_3Al$ particles dispersed throughout the alloy matrix find their origin in a spinodal decomposition of the supersaturated solid solution followed by coarsening and transformation of the solute rich regions into $Ni_3Al$ pre-precipitates and equilibrium precipitate particles. These particles are formed by a spinodal decomposition mechanism that provides for the unusual properties obtained in accordance with the present invention.

The alloy of the present invention may be cast in any convenient manner such as direct chill or continuous casting. The alloy should be homogenized at temperatures between 600° C and the solidus temperature of the particular alloy for at least 15 minutes followed by hot rolling with a finishing temperature in excess of 400° C. For example, a representative alloy composition containing 15% nickel and 2% aluminum of the present invention has a solidus temperature of 1120° C. The homogenizing procedure may be combined with the hot rolling procedure, that is, the alloy may be heated to hot rolling starting temperature and held at said starting temperature for the requisite period of time. The hot rolling starting temperature should preferably be in the solid solution range appropriate to the particular composition.

Following hot rolling, the alloy may be cold rolled at a temperature below 200° C with or without intermediate annealing depending upon particular gage requirements. In general, annealing may be performed using strip or batch processing with holding times of from 10 seconds to 24 hours at temperatures from 250° C to within 50° C of the solidus temperature for the particular alloy.

The alloy should then be given a solution treatment within the temperature range of 650° C to 1100° C, and generally above 800° C. This is a key step in the processing of the present invention since this step is required for the formation on cooling of the extremely finely dispersed $Ni_3Al$ particles by a spinodal decomposition mechanism. The solution annealing step should be carried out for from 10 seconds to 24 hours.

Following solution annealing, the material should be cooled to room temperature. In accordance with the present invention it has been found that critical control of processing parameters can result in significantly different property combinations. In particular, it has been found that the cooling rate from the solution treatment temperature is important in controlling the morphology of the precipitation product upon subsequent aging of solution treated or solution treated and cold rolled material. When the alloys are water quenched from solution treatment, for example, cooled at average rates of 650° C per minute or faster, one observes the discontinuous type (2) and possibly also the agglomerated type (1) of $Ni_3Al$ precipitate in the aged product. Material which is water quenched from solution treatment followed by cold rolling and aging results in a mixture of all three types of $Ni_3Al$ precipitates. When the alloys are slowly cooled from solution treatment, for example, at average rates of 80° C per minute or less, one observes type (3) of $Ni_3Al$ type precipitate formed as an array of extremely finely dispersed, coherent particles. This is observed in the solution treated product per se or in the solution treated and aged product or in the solution treated cold rolled and aged product. Alternatively, one may simply cool the solution annealed product directly to aging temperature, age at the aging temperature followed by cooling to room temperature, resulting in the foregoing type of precipitate (3).

Thus, following solution annealing one may cool the material using a slow cooling mechanism or quenching mechanism as indicated hereinabove. In addition, one may age the solution treated material at a temperature of from 250° C to 650° C for times of from 30 minutes to 24 hours. The final condition of the material may be either solution treated, solution treated and aged, or solution treated, cold rolled and aged.

Alternatively, one may provide additional cold rolling after the aging treatment. This additional cold rolling results in additional strength but loss in formability and ductility.

For applications where maximum ductility is desired the alloy should be quenched after the solution anneal. Subsequent cold rolling and aging generates both higher strength and better ductility than the as cold rolled metal. This improvement in both of these properties with aging is quite remarkable.

If maximum strength is desired rather than maximum ductility, the alloys should be slowly cooled from the solution anneal. Subsequent processing of this condition, including cold rolling and aging, results in increased strength with only slight loss in formability. It is quite surprising that material slowly cooled from solution annealing in this manner exhibits an aging response. Thus, the alloys of the present invention may be processed to obtain a variety of properties related to control of the cooling rate following the solution anneal at a temperature of from 650° C to 1100° C. The aging step at temperatures of from 250° C to 650° C for times of from 30 minutes to 24 hours results in improved property combinations. The alloys may optionally be cold rolled, for example, up to 90%, between the solution anneal and the aging steps, if desired, with the particular variations and the degree of rolling depending upon the final property requirements.

Parts may be formed from cold rolled and/or aged material, with an optional heat treatment after forming. The heat treatment may be an aging treatment as above, or a low temperature thermal treatment at 150°–300° C for at least 15 minutes to enhance stress relaxation or stress corrosion resistance.

The present invention and improvements resulting therefrom will be more readily understandable from a consideration of the following illustrative examples.

EXAMPLE I

Tensile Properties

An alloy consisting of 15 wt. % nickel and 2 wt. % aluminum, balance copper was cast from 1350° C into a steel mold with a water-cooled copper base plate. The 10 pound ingot was soaked at 1000° C for 4 hours, immediately hot rolled to 0.4 inch from 1.75 inches with a finishing temperature of about 500° C and cold rolled to 0.120 inch. The alloy was solution treated at 850° C for 1 hour followed by water quenching to room temperature. The alloy was further processed to provide metal at 0.020 inch gauge in the as-quenched and 20, 40, 60 and 83% cold rolled condition. Some metal was cold rolled directly to 0.020 inch, that is, 83% cold rolled metal. Some metal was cold rolled to 0.050 inch gauge again solution treated 1 hour at 850° C and cold rolled to 0.020 inch gauge, i.e., 60% cold rolled metal. Some metal was cold rolled to 0.033 inch gauge, solution treated 1 hour at 850° C and cold rolled to 0.020 inch gauge, i.e., 40% cold rolled metal. Some metal was cold rolled to 0.025 inch gauge solution treated 1 hour at 850° C and cold rolled to 0.020 inch gauge, i.e., 20% cold rolled metal. Some of the 60% cold rolled metal was solution treated at 850° C/1 hr. to provide solution treated metal, i.e., 0% reduction. After every solution treatment the metal was water quenched to room temperature. Some of each of the cold rolled metal at 0.020 inch was heat treated (aged) at 400° C for 24 hours. Tensile properties were measured for both the as-cold rolled and heat treated material. These tensile properties are listed in Table I. These properties are compared with those of the commercial high strength copper base alloys CDA 510 (4.4% tin, 0.07% phosphorus, balance copper) and CDA 638 (2.7% aluminum, 1.7% silicon, 0.4% cobalt, balance copper). The data in Table I clearly demonstrate the significant heat treated strength and strength/ductility combination advantages obtained in accordance with the alloy of the present invention. The microstructures of the aged materials of the present invention were examined and found to contain finely dispersed precipitates of $Ni_3Al$ particles dispersed throughout the matrix.

Table I

Tensile Properties of Cu-15Ni-2Al Water Quenched from the Solution Treatment

| Alloy | % Cold Reduction | 0.2% Yield Strength (ksi) | Ultimate Tensile Strength (ksi) | Elongation (%) |
|---|---|---|---|---|
| Cu-15Ni-2Al | 0 | 22 | 60 | 32.8 |
| Cu-15Ni-2Al | 0 + Aged | 76 | 113 | 17.2 |
| CDA 510 | 0 | 40 | 56 | 46.0 |
| CDA 638 | 0 | 51 | 80 | 35.0 |
| Cu-15Ni-2Al | 20 | 59 | 66 | 13.3 |
| Cu-15Ni-2Al | 20 + Aged | 81 | 115 | 17.7 |
| CDA 510 | 20 | 65 | 72 | 20.0 |
| CDA 638 | 20 | 82 | 106 | 10.0 |
| Cu-15Ni-2Al | 40 | 78 | 81 | 1.0 |
| Cu-15Ni-2Al | 40 + Aged | 91 | 120 | 16.8 |
| CDA 510 | 40 | 93 | 97 | 5.0 |
| CDA 638 | 40 | 99 | 120 | 5.0 |
| Cu-15Ni-2Al | 60 | 84 | 86 | 1.3 |
| Cu-15Ni-2Al | 60 + Aged | 105 | 125 | 15.0 |
| CDA 510 | 60 | 107 | 110 | 2.0 |
| CDA 638 | 60 | 110 | 130 | 3.0 |
| Cu-15Ni-2Al | 83 | 90 | 92 | 1.0 |
| Cu-15Ni-2Al | 83 + Aged | 118 | 141 | 14.0 |
| CDA 510 | 83 | 114 | 120 | 1.0 |
| CDA 638 | 83 | 118 | 139 | 1.0 |

EXAMPLE II

Tensile Properties

An alloy consisting of 15 wt. % nickel and 2 wt. % aluminum was cast and processed as described in Example I, except that the metal was air cooled to room temperature following each solution treatment. Again, the tensile properties were measured for both the as-cold rolled and heat treated (aged) condition. The microstructures of the solution treated, solution treated and cold rolled, and solution treated, cold rolled and aged conditions of the alloys of the present invention were examined and found to contain finely dispersed precipitates of $Ni_3Al$ particles dispersed throughout the matrix. Compared with the properties of the two commercial high strength Alloys 510 and 638 in Table I, the data in Table II clearly demonstrates the significant rolled temper strength advantage as well as the heat treated strength advantages obtained in accordance with processing the alloy of the present invention in this way. It is particularly surprising that slowly cooled, heat treatable alloys can be cold rolled to such an extent as in this example without breaking up.

Table II

Tensile Properties of Cu-15Ni-2Al Air-Cooled from the Solution Treatment

| Condition | 0.2% Yield Strength (ksi) | Ultimate Tensile Strength (ksi) | Elongation (%) |
|---|---|---|---|
| Solution treated | 46 | 88 | 28.0 |
| S.T. + Aged | 52 | 92 | 19.7 |
| CR 20% | 128 | 133 | 4.8 |
| CR 20% + Aged | 132 | 137 | 2.9 |
| CR 40% | 132 | 142 | 1.0 |
| CR 40% + Aged | 144 | 154 | 2.1 |
| CR 60% | 131 | 142 | 2.0 |
| CR 60% + Aged | 148 | 158 | 2.1 |
| CR 83% | 125 | 139 | 3.5 |
| CR 83% + Aged | 151 | 170 | 3.0 |

EXAMPLE III

Bend Formability Properties

The bend formability of the Cu-15Ni-2Al alloy, processed as in Examples I and II, was evaluated. In particular, the 90° bend property for the heat treated (aged) condition was measured. The bend properties determine the minimum radius about which strip can be bent without cracking. Where the bend is made about an axis either perpendicular to or parallel to the rolling direction, the longitudinal properties (goodway) refer to the axis perpendicular to the rolling direction, while the transverse properties (badway) refer to the axis parallel to the rolling direction. MBR is the smallest radius which does not show cracks and $t$ is the thickness of the strip, i.e., all at 0.020 inch gauge in this case. The resulting bend data are presented in Tables IIIA, IIIB, IIIC and IIID. Tables IIIA and IIIB compare the bend properties of Cu-15Ni-2Al that had been processed with water quenching and air cooling, respectively. Table IIIC compares the MBR/$t$ available for Alloys 510 and 638 with the MBR/$t$ for an alloy of the present invention. Surprisingly, for a given strength level, the heat treated alloy of the present invention offers greater bend formability, either goodway or badway, i.e., lower MBR/$t$, than do Alloys 510 and 638. Table IIID is a similar comparison showing the higher yield strength available at a given MBR/$t$ for the alloys of this invention compared to Alloys 510 and 638. It is commercially desirable to obtain higher strength for a given bend radius and the heat treated Cu-15Ni-2Al alloy offers greater strength for a given bend radius, especially in the critical badway mode, than the high strength commercial wrought Alloys 510 and 638. It is particularly significant that the alloy of the present invention has adequate bend ductility at strength levels the other alloys cannot attain.

Table IIIA

Bend Properties of Cold Rolled and Aged Cu-15Ni-2Al, That Had Been Water Quenched From The Solution Treatment Temperature

| Condition* | Aged 0.2% Ys, ksi | Minimum Bend Radius / thickness Cu-15Ni-2Al G.W. | B.W. |
|---|---|---|---|
| Quenched + Aged | 76 | sharp | sharp |
| CR 20% + Aged | 81 | 0.4 | 1.6 |
| CR 40% + Aged | 91 | 0.4 | 0.4 |
| CR 60% + Aged | 105 | 0.8 | 1.6 |

Table IIIA-continued

| Condition* | Aged 0.2% Ys, ksi | Minimum Bend Radius / thickness Cu-15Ni-2Al G.W. | B.W. |
|---|---|---|---|
| CR 83% + Aged | 118 | 7.8 | 9.4 |

*Aged 400° C–24 hrs. at 0.020" gauge

Table IIIB

Bend Properties of Cold Rolled and Aged Cu-15Ni-2Al, That Had Been Air Cooled From The Solution Treatment Temperature

| Condition* | Aged 0.2% Ys, ksi | Minimum Bend Radius / thickness Cu-15Ni-2Al G.W. | B.W. |
|---|---|---|---|
| Cooled + Aged | 52 | sharp | sharp |
| CR 20% + Aged | 132 | 6.2 | 5.5 |
| CR 40% + Aged | 144 | 6.2 | 5.5 |
| CR 60% + Aged | 148 | 6.2 | 7.8 |
| CR 83% + Aged | 151 | 7.8 | 12.5 |

*Aged 400° C–24 hrs. at 0.020" gauge

Table IIIC

Comparison of Bend Properties of Cold Rolled And Aged Cu-15Ni-2Al With Those of Temper Rolled CDA 510 And 638

| 0.2% Yield Strength, ksi | Minimum Bend Radius / thickness Cu-15Ni-2Al G.W. | B.W. | 510 G.W. | B.W. | 638 G.W. | B.W. |
|---|---|---|---|---|---|---|
| 80 | 0.2 | 0.2 | 0.2 | 1.6 | 0.8 | 2.1 |
| 90 | 0.4 | 0.4 | 0.4 | 3.2 | 1.5 | 3.3 |
| 100 | 0.7 | 1.1 | 1.0 | 4.3 | 2.2 | 4.3 |
| 110 | 1.4 | 2.0 | 1.8 | 9.0 | 3.2 | 10.0 |
| 120 | 2.4 | 3.2 | — | — | 4.8 | >25 |
| 130 | 4.2 | 5.0 | — | — | — | — |
| 140 | 5.7 | 7.0 | — | — | — | — |

Table IIID

Comparison of Strength/Bend Property Combinations of Cold Rolled and Aged Cu-15Ni-2Al With Those of Temper Rolled CDA 510 And CDA 638

| Goodway | 0.2% Yield Strength, ksi Aged | Cold Rolled | Cold Rolled |
|---|---|---|---|
| 1 | 98 | 76 | 70 |
| 2 | 110 | 84 | 79 |
| 3 | 118 | 90 | 89 |
| 4 | 125 | 95 | 95 |
| 5 | 131 | 99 | 99 |
| 6 | 137 | 102 | 102 |

| MBR/t | Cu-15Ni-2Al | 510 | 638 |
|---|---|---|---|
| 1 | 105 | 101 | 85 |
| 2 | 116 | 111 | 97 |
| 3 | 123 | — | 107 |
| 4 | 129 | — | 117 |
| 5 | 135 | — | 120 |
| 6 | 142 | — | — |
| Badway MBR/t | | | |

Table IIID-continued

Comparison of Strength/Bend Property Combinations of Cold Rolled and Aged Cu-15Ni-2Al With Those of Temper Rolled CDA 510 And CDA 638

| | 0.2% Yield Strength, ksi | | |
|---|---|---|---|
| 1 | 98 | 76 | 70 |
| 2 | 110 | 84 | 79 |
| 3 | 118 | 90 | 89 |
| 4 | 125 | 95 | 95 |
| 5 | 131 | 99 | 99 |
| 6 | 137 | 102 | 102 |

EXAMPLE IV

High Strength Bend Formability

The surprising advantage of the alloy of the present invention is that in the high strength aged condition it provides excellent strength/ductility combinations. This effect is not observed with the commercially available high strength, age hardening copper base alloys such as beryllium-copper and Cu-9Ni-6Sn (nominal). To take advantage of their high strength capabilities, these latter two alloys are also solution treated, cold rolled and aged. But a part that must be formed with a pressing or bending operation, such as would be required by a typical electrical contact spring component, must be formed in the cold rolled condition and aged after the part is formed. In practice, this latter procedure requires that the formed component be adequately supported with expensive fixture arrangements to avoid the unwanted distortion that occurs during the aging treatment. An alternative approach is to cold roll the solution treated conditions and underage the strip so that adequate bend formability at reasonable strength would be attained without a post-forming heat treatment. But, this latter process results in under-utilization of the strength capability of these expensive materials. The advantage of the alloy of the present invention is that adequate bend formability is achieved when the solution treated and cold worked material is heat treated (aged) to high strength. This latter situation allows the full utilization of the high strength along with adequate bend formability. Table IV shows this advantage by comparing tensile and bend data for Cu-15Ni-2Al, beryllium-copper and a Cu-9Ni-6Sn alloy.

Table IV

Mechanical Properties of High Strength Copper Alloys

| Alloy and Condition | 0.2% YS (ksi) | Ultimate Tensile Strength (ksi) | Elongation % | MBR/t Goodway | Badway |
|---|---|---|---|---|---|
| Cu-15Ni-2Al | | | | | |
| Cold Rolled 40% | 132 | 142 | 1.0 | 3.9 | 5.0 |
| Aged 400° C–24 hrs. | 144 | 154 | 2.1 | 6.2 | 5.0 |
| Cu-11.9Ni-4.8Sn | | | | | |
| Cold Rolled | 112 | 122 | 2.7 | 2.8 | 2.8 |
| Aged | 134 | 142 | 5.0 | 11.1 | >11.1 |
| CDA 172 (Cu-1.9Be-0.2Co) | | | | | |
| Cold Rolled + Underaged | 107 | 135 | 14.8 | 1.2 | 1.5 |

EXAMPLE V

High Strength Copper-Nickel-Aluminum Base Alloys

To show the high strength provided by quarternary and quinary additions to a 15Ni-2Al composition as well as deviations from these nickel and aluminum contents in the ternary copper alloy, the tensile data in Table V are presented. These properties were measured on these alloys in the solution treated, cold rolled and heat treated conditions. The alloys had been processed (cast and hot rolled and cold rolled) according to the processing described in Examples I and II. The solution treatment temperature was 1000° C. The microstructures of all materials were examined and found to contain finely dispersed precipitates of $Ni_3Al$ particles dispersed throughout the matrix. In addition, the microstructures of the chromium, vanadium and titanium containing alloys showed the presence of second precipitate particles as described above.

Table V

Tensile Properties of Various Solution Treated-Cold Rolled and Heat Treated (Aged) Copper-Nickel-Aluminum Base Alloys

| Alloy | 0.2% Yield Strength (ksi) | Ultimate Tensile Strength (ksi) | Elongation (%) |
|---|---|---|---|
| Cu-15Ni-2Al-2Cr | 150 | 168 | 1.6 |
| Cu-20Ni-3Al | 176 | 193 | 0.8 |
| Cu-15Ni-2Al-6Fe | 160 | 180 | 2.0 |
| Cu-15Ni-2Al-2Cr-0.5 Ti | 171 | 184 | 0.3 |
| Cu-15Ni-2Al-1V | 166 | 185 | 5.0 |
| Cu-15Ni-3Al | 155 | 193 | 2.7 |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for obtaining a spinodal, precipitation hardened copper base alloy having high strength and favorable strength to ductility characteristics which comprises:

A. providing a copper base alloy consisting essentially of from 10 to 30% nickel, from 1 to 5% aluminum, balance copper;

B. hot working said alloy with a finishing temperature in excess of 400° C;

C. solution annealing said alloy for from 10 seconds to 24 hours at a temperature of from 650° to 1100° C; and D. cooling the alloy to room temperature to provide a spinodal, precipitation hardened copper base alloy wherein the microstructure is characterized by the presence of finely dispersed precipitates of $Ni_3Al$ particles dispersed throughout the matrix.

2. A method according to claim 1 wherein said alloy includes a total of up to 20% of a material selected from the group consisting of from 0.01 to 10% zinc, from 0.01 to 10% iron, from 0.01 to 10% tin, from 0.01 to 5% each of titanium, zirconium, beryllium, vanadium, niobium, tantalum, chromium, molybdenum, tungsten and mixtures thereof, and wherein the resultant microstructure is characterized by the presence of second precipitate particles.

3. A method according to claim 1 wherein said alloy includes a total of up to 5% of a material selected from the group consisting of lead, arsenic, antimony, boron, phosphorus, manganese, silicon, a lanthanide metal, magnesium, lithium and mixtures thereof, with each of said materials being present in an amount from 0.001 to 3%.

4. A method according to claim 1 wherein said alloy is homogenized prior to hot working at a temperature between 600° C and the solidus temperature of the alloy for at least 15 minutes.

5. A method according to claim 1 wherein said alloy is cold worked following hot working but before solution annealing.

6. A method according to claim 5 wherein all working steps are rolling.

7. A method according to claim 6 wherein said alloy is cold rolled with intermediate annealing at from 250° C to within 50° C of the solidus temperature for from 10 seconds to 24 hours.

8. A method according to claim 1 wherein said alloy is water quenched following solution annealing.

9. A method according to claim 8 wherein the alloy is aged following quenching at a temperature of from 250° to 650° C for from 30 minutes to 24 hours.

10. A method according to claim 9 wherein the alloy is cold rolled and aged following quenching.

11. A method according to claim 1 wherein the alloy is slowly cooled following solution annealing.

12. A method according to claim 11 wherein the alloy is aged following slowly cooling at a temperature of from 250° to 650° C for from 30 minutes to 24 hours.

13. A method according to claim 12 wherein the alloy is cold rolled and aged following slowly cooling.

* * * * *